US006683417B2

(12) United States Patent
Lee et al.

(10) Patent No.: US 6,683,417 B2
(45) Date of Patent: Jan. 27, 2004

(54) ORGANIC ELECTRO LUMINESCENT DISPLAY DEVICE

(75) Inventors: Han-Sang Lee, Gwanak-Ku (KR); Chang-Yeon Kim, Seoul (KR); Myung-Ho Lee, Gyeonggi-Do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/326,161

(22) Filed: Dec. 23, 2002

(65) Prior Publication Data

US 2003/0122496 A1 Jul. 3, 2003

(30) Foreign Application Priority Data

Dec. 29, 2001 (KR) ..... 2001-88604

(51) Int. Cl.[7] ..... G09G 3/10

(52) U.S. Cl. ..... 315/169.3; 315/169.1; 315/169.2; 345/84; 345/76; 345/63

(58) Field of Search ..... 315/169.3, 169.1, 315/169.2; 345/63, 68, 72, 77, 76, 82, 83, 84

(56) References Cited

U.S. PATENT DOCUMENTS 6,573,952 B1 * 6/2003 Yamazaki et al. ..... 349/13
6,611,108 B2 * 8/2003 Kimura ..... 315/169.3

* cited by examiner

*Primary Examiner*—Haissa Philogene
(74) *Attorney, Agent, or Firm*—McKenna Long & Aldridge LLP

(57) ABSTRACT

A driving circuit of an organic electro luminescence display device for reducing driving power consumption. The reduction is accomplished by constructing power voltage supplying lines on respective pixels individually and constructing common electrodes on respective pixels for individually applying common voltages to the respective pixels. Alternatively, constructing power voltage supplying lines and the common electrodes on the pixels individually, thereby supplying power voltages appropriate for the respective R, G and B pixels individually.

18 Claims, 8 Drawing Sheets

ORGANIC ELECTRO LUMINESCENT DISPLAY DEVICE

This application claims the benefit of Korean Patent Application No. 2001-88604, filed on Dec. 29, 2001, which is hereby incorporated by reference for all purposes as if fully set forth herein.

BACKGROUND OF THE INVENTION

1. Field of the Invention

The present invention relates to an organic electro luminescent display device, and more particularly to an organic electro luminescent display device which is able to achieve a low level of electric power consumption.

2. Discussion of the Related Art

Presently, there is a high demand for display devices to keep up with the high rate of growth of an information technology based society. Currently, one hundred million (100,000,000) cathode ray tubes (CRT) are required globally per year as display devices for desktop computers. Liquid crystal display (LCD) devices are used in notebook computers and can be applied to monitors, digital cameras and the like. An LCD is a non-emitting device and the image is displayed by a back light, while the CRT and electroluminescence (EL) device are self-luminescent display devices. For example, the EL device can be divided into an inorganic EL device or an organic EL device depending on the fluorescent compound used.

The inorganic EL device can be classified as a distributed type, a thin film type, and an inorganic EL device. The inorganic EL device is operated by alternating current (AC), and the brightness of the device is dependent on voltage and frequency used.

The organic EL device has many advantages over LCD devices including a larger viewing angle, higher contrast, and superior visibility due to the self-luminescent characteristics. Additionally, because the organic EL device does not require a back light, it can take a thinner and lighter form than a LCD device, and it has lower electric consumption than the LCD. While the back light of the LCD must be on the entire surface, regardless of the displayed contents, the organic EL device is able to transmit current only to the pixels that need to be lighted. The EL device can be operated by low voltage direct current (DC) and is able to display moving pictures easily as it has a fast response speed. Accordingly, the organic EL device is being highlighted as the display for IMT-2000 standard. The organic EL device also has a wider temperature range of usage and is more resistant to vibration than the LCD device.

In the above organic EL device, positive and negative electrodes are generally formed on a transparent substrate, for example, glass, facing each other with an organic emitting layer formed therebetween. Light is emitted from the organic emitting layer by a voltage applied between the positive and negative electrodes. The positive electrode is formed by sputtering an indium-tin-oxide (ITO) thin film having high electric conductivity and light transmittance. Accordingly, light emitted from the organic emitting layer can be transmitted smoothly. The negative electrode is formed using a metal having a low work function, thereby applying the electrons smoothly.

Therefore, when the alternating (+) and (−) voltages are applied to the positive electrode and to the negative electrode, respectively, holes are injected from the positive electrode and electrons are injected from the negative electrode and combined in the organic emitting layer to emit the light. Additionally, the organic emitting layer comprises a hole transport layer, an emitting layer, and an electron transport layer.

In the organic EL display device, unit pixels are disposed in a matrix form. In addition, organic emitting layers of the unit pixels are driven selectively through thin film transistors disposed on respective unit pixels to display an image.

Hereinafter, the organic EL device having the above characteristics will be described in detail.

FIG. 1 is a view showing an equivalent circuit of the organic EL device having unit pixels with two thin film transistors disposed in a matrix form.

The unit pixel of the organic EL device, as shown in enlarged area A, comprises an Nth line of gate scan line (Gn) for supplying gate signals, an Mth column of data line (Dm) for supplying data signals, an Mth column of power voltage line (Pm) for supplying power voltage from one power voltage supplying line P, and first and second thin film transistors 10 and 20 formed on an area defined by the Gn, Dm, and Pm.

At that time, the gate scan line (Gn) and the data line (Dm) vertically cross each other, and an organic luminescence device 30 and the first and second thin film transistors 10 and 20 for driving the organic luminescence device 30 are disposed around the crossing point of the Gn and Dm.

The first thin film transistor 10 includes a source electrode 12 for receiving a data signal by an electrical connection to the gate scan line Gn. A drain electrode 13 is connected to a gate electrode of the second thin film transistor 20 for switching the organic luminescence device 30.

Additionally, the second thin film transistor 20 comprises a gate electrode 21 connected to the drain electrode 13 of the first thin film transistor 10. A drain electrode 22 is connected to a positive electrode of the organic luminescence device 30 and a source electrode 23 is connected to the power voltage line (Pm). Therefore, the second thin film transistor 20 functions as a transistor for driving the organic luminescence device 30.

Although, not shown in detail in FIG. 1, the organic luminescence device 30 comprises a positive electrode (+) connected to the drain electrode 22 of the second thin film transistor 20. A negative electrode (−) is connected to a common electrode and an organic emitting layer 31 formed by being inserted between the positive electrode (+) and the negative electrode (−). Additionally, the organic emitting layer 31 comprises a hole transport layer, an emitting layer, and an electron transport layer.

Further, the organic luminescence device 30, comprising a capacitor having one electrode is connected to the power voltage line (Pm). The other electrode is connected to the drain electrode 13 of the first thin film transistor 10 and to the gate electrode 21 of the second thin film transistor 20, commonly. The power voltage line (Pm) is connected to the power voltage supplying line P, disposed on the edge of the panel. The power voltage is supplied to respective pixels by the power supplying lines, which are divided from one power supplying line regardless of emitted color on the organic luminescence device.

The power voltages required by the respective pixels are different for the various desired emitted colors of the organic luminescence device. That is, the operating voltage needed to radiate a blue color luminescence device is different from the operating voltage for radiating a red color luminescence device. Additionally, the operating voltage for emitting a green color luminescence device is also different. For example, the required operating voltages are in order of blue (B)>red (R)>green (G).

For example, the power voltage is applied to all colors of devices. The operating voltage of the blue luminescence device has the highest operating voltage and one power voltage supplying line and a common electrode as in the related art. There are voltage differences between the applied power voltage and the voltages required to operate the G pixel and the R pixel which can be operated by small applied voltages.

In addition, the voltage difference between the operating voltage and the source voltage is a principal cause of electric power consumption increase.

SUMMARY OF THE INVENTION

Accordingly, the present invention is directed to an organic electro luminescent display device that substantially obviates one or more of the problems due to the limitations and disadvantages of the related art.

An advantage of the present invention is to reduce the amount of electric power used in the panel of an organic luminescence device. This may be accomplished, for example, by setting a power voltage supplying line or a common electrode individually on R, G, and B pixels. Accordingly, the appropriate operating voltages can be supplied to the respective pixels.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is provided an organic electro luminescent display device which includes a gate scan line and a data line, wherein the data line and the gate scan line cross. Red (R), green (G), and blue (B) pixels are arranged in a matrix form in an area where the gate scan line and the data line cross. An organic luminescence device corresponding to the R, G, and B pixels for emitting R, G, and B colors by an electric field applied to a positive (+) and negative (−) electrodes is provided. A switching unit for switching image information applied from the data line by a scan signal applied from the gate scan line and a driving unit for applying the electric field to the organic luminescence device according to an image information applied through the switching unit are provided. A power voltage supplying line formed individually on the R, G and B pixels for applying different power voltages to the driving units is formed on the respective pixels. A common electrode for supplying a common voltage to the organic luminescence device is provided.

The organic luminescence device supplies only the required operating voltages to the respective R, G, and B pixels. Accordingly, power consumption advantages are present.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 1:
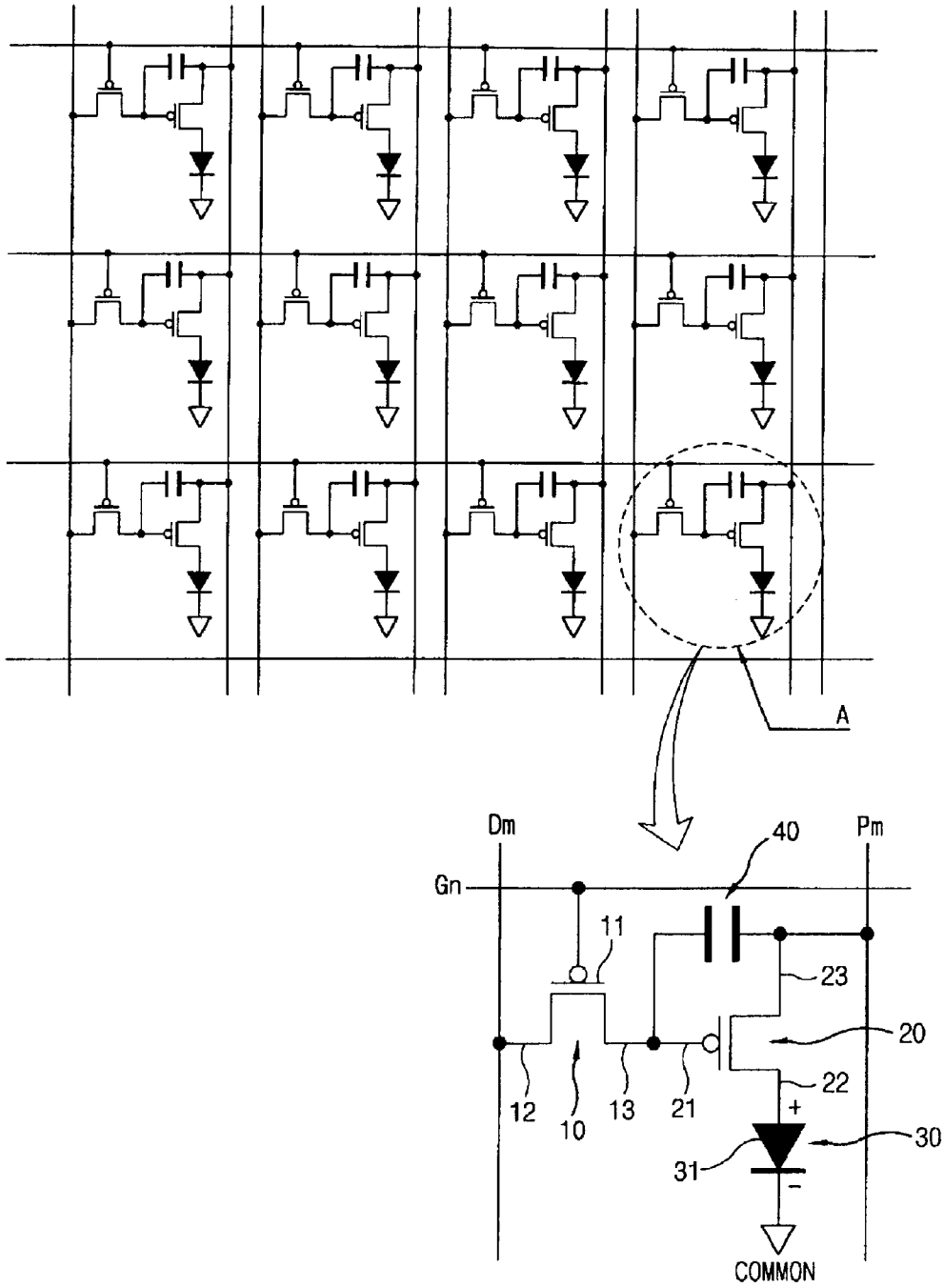
FIG. 1 BACKGROUND ART
FIG. 1 is an equivalent circuit diagram showing an organic electro luminescent (EL) display device on which unit pixels including two thin film transistors are respectively disposed as a matrix form of the related art.
Figure 2:
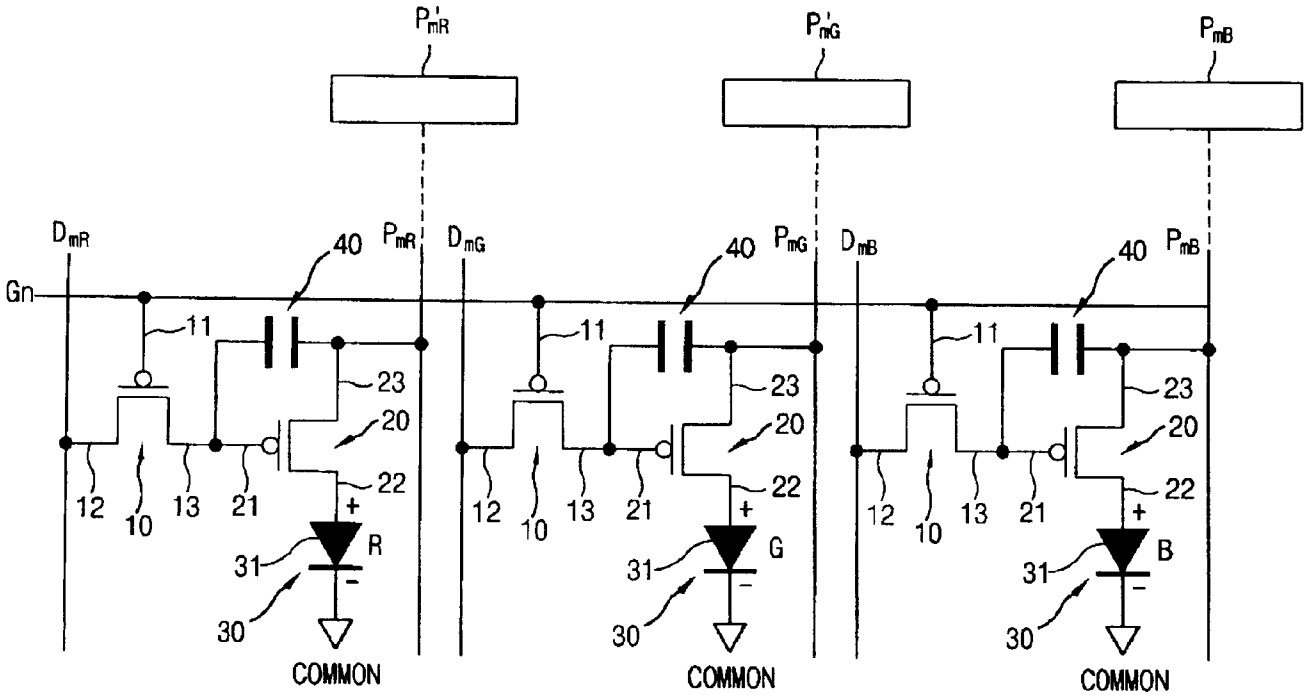
FIGS. 2 to 4 are equivalent circuit diagrams showing an organic luminescence device on which two thin film transistors are disposed on a unit pixel and operated by voltage according to the present invention.

FIG. 2 is an equivalent circuit diagram showing an organic luminescence device according to the present invention.

Referring to FIG. 2, an organic electro luminescence (EL) device of two thin film transistor (2-TFT) method is shown. A TFT for switching and a TFT for driving are disposed in the respective pixels. An operating voltage can be supplied to respective R, G, and B pixels from power voltage supplying lines constructed on the respective pixels.

The organic EL device comprises n lines of gate scan lines (Gn) for supplying gate signals, m columns of data lines by pixels ($D_{mR}$, $D_{mG}$, $D_{mB}$) for supplying data signals to respective pixels, and m columns of power voltage lines ($P_{mR}$, $P_{mG}$, $P_{mB}$) formed on R, G, and B pixels for supplying operating voltages required by respective pixels from power voltage supplying line ($P'_{mR}$, $P'_{mG}$, $P'_{mB}$). First and second thin film transistors 10 and 20 are formed on an area divided by the gate line, the data line, and the power line.

The gate scan lines (Gn) and data lines ($D_{mR}$, $D_{mG}$, $D_{mB}$) cross each other. The organic luminescence device (R, G or B) 30, first thin film transistor 10, and second thin film transistor 20 are arranged around the crossing of the gate scan lines and data lines.

The first thin film transistor 10 comprises a source electrode 12 connected to the data line (Dm) which supplies the data signal. The drain electrode 13 which is connected to a gate electrode 21 of the second thin film transistor 20 switches the organic luminescence device 30.

Additionally, the second thin film transistor 20 comprises a gate electrode 21 connected to the drain electrode 13 of the first thin film transistor 10. The drain electrode 22 of the second thin film transistor 10 is connected to the positive electrode (+) of the organic luminescence device 30. The source electrode 23 is connected to the power voltage line ($P_{mR}$, $P_{mG}$, $P_{mB}$) and functions as a transistor for driving the organic luminescence device 30. A capacitor 40 is formed having one electrode connected to the power voltage line ($P_{mR}$, $P_{mG}$, $P_{mB}$) and the other electrode connected commonly to the drain electrode 13 of the first thin film transistor 10 and to the gate electrode 21 of the second thin film transistor 20.

The power voltage supplying lines ($P'_{mR}$, $P'_{mG}$, $P'_{mB}$) are formed on the respective pixels for supplying operating voltages required by the respective R, G, and B pixels to the power voltage lines ($P_{mR}$, $P_{mG}$, $P_{mB}$). The power voltage lines are connected to the source electrode 23 of the second thin film transistor. That is, the operating voltages of the R, G, and B pixels vary for the desired emitted colors. For example, a low voltage is supplied from the power voltage supplying line ($P'_{mG}$) to the power voltage line ($P_{mG}$) for the green (G) pixel which has the lowest operating voltage. A high voltage is supplied from the power voltage supplying line ($P'_{mB}$) to the power voltage line ($P_{mB}$) for the blue (B) pixel which has the highest operating voltage. Accordingly, the power consumption can be minimized in this way.

Although not shown in Figures, the respective power voltage supplying lines may be formed on the panel. However, it is desirable that the power voltage supplying lines are formed on a printed circuit board installed on outer side of the panel, thereby preventing the temperature of the panel from rising due to temperature increases of the power voltage supplying lines.

Hereinafter, operations of the equivalent circuit of the organic EL device constructed as above will be described in detail as follows.

When a gate signal is applied to the gate electrode 11 from the gate scan line (Gn) the first thin film transistor 10 is electrically turned on. The data signal supplied from the data line ($D_{mR}$, $D_{mG}$, $D_{mB}$) of the respective pixel is supplied to the gate electrode 21 through the source electrode 12 and the drain electrode 13. Accordingly, the potential of the gate electrode 21 becomes the same as that of the data line ($D_{mR}$, $D_{mG}$, $D_{mB}$).

Therefore, the second thin film transistor 20 is turned on by the voltage supplied to the gate electrode 21. The electric current corresponding to the voltage supplied to the gate electrode 21 is supplied to the organic luminescence device 30 from the power voltage line ($P_{mR}$, $P_{mG}$, $P_{mB}$).

Light from the organic luminescence device 30 is emitted by the degree of supplied electric current. Consequently, the strength of the emitted light is varied by the degree of current of data signal which is applied through the data line ($D_{mR}$, $D_{mG}$, $D_{mB}$).

The organic luminescence device has different operating voltages according to the emitted colors. Therefore, the currents corresponding to the respective R, G, and B emitted colors are supplied from the power voltage supplying lines ($P'_{mR}$, $P'_{mG}$, $P'_{mB}$) constructed by the pixels.

Generally, in the organic luminescence device, gate signals are supplied sequentially from the first gate scan line to the last gate scan line in order to display the entire image on the screen. The capacitor 40 maintains the luminescence of the organic luminescence device 30. This is accomplished by charging the gate signal which was previously supplied to the gate scan line (Gn) until the gate signal is supplied again to the corresponding gate scan line (Gn).

As described above and according to the present embodiment, the power voltage supplying line is constructed individually on the respective R, G, and B pixels for supplying the operating voltage required by the respective pixels, thereby, reducing the amount of power consumption of the organic EL device.

According to another embodiment, a common electrode connected to the negative electrode (−) of the organic luminescence device may be constructed individually on the respective pixel. Accordingly, the power consumption may be reduced.

Figure 3:
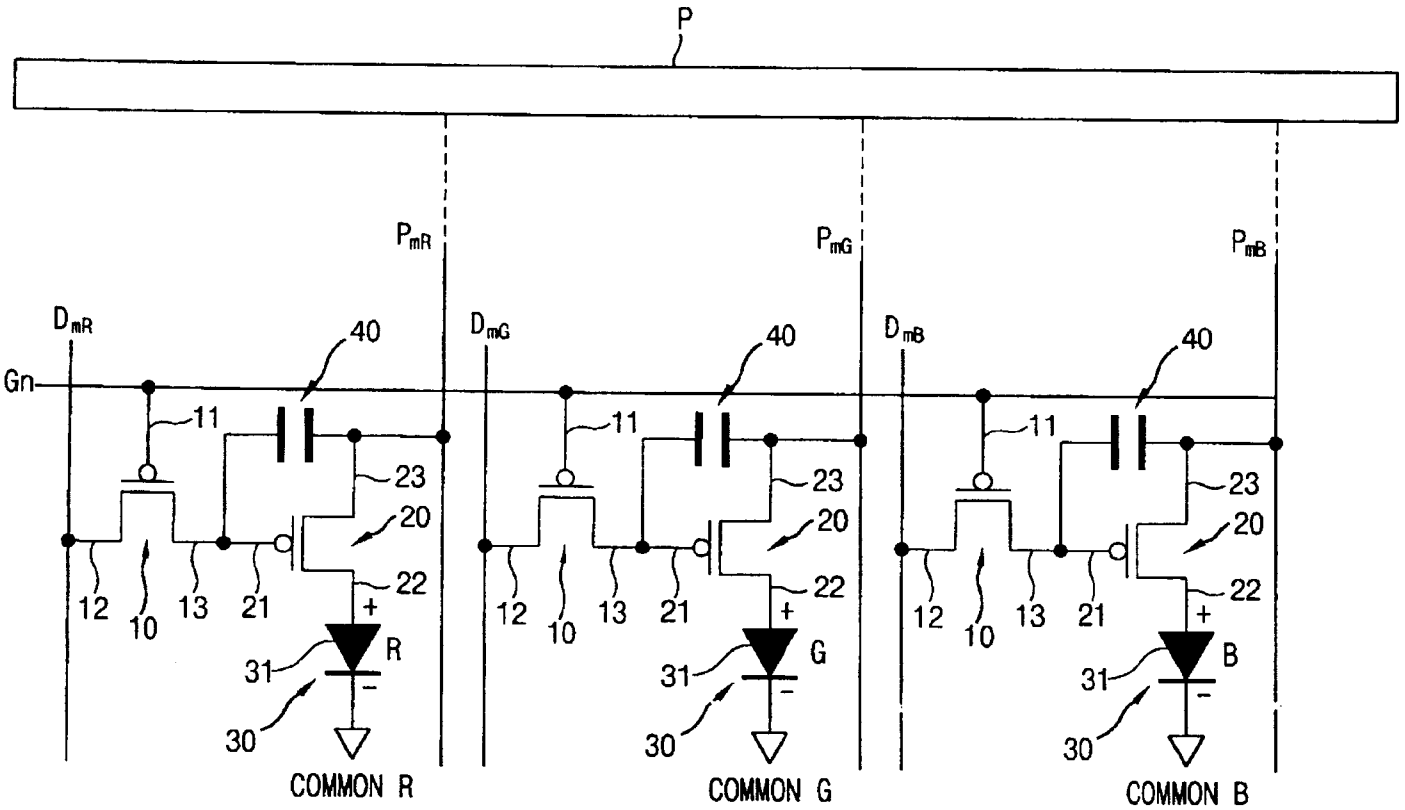

FIG. 3 represents another embodiment of the present invention in which common electrodes (common_R, common_G, common_B) are constructed so as to individually supply the common voltage required by the R, G and B pixels.

Referring to FIG. 3, the power voltage supplying line P supplies the same power voltages to the pixels regardless of the R, G, and B pixels. The common electrodes (common_R, common_G, common_B) are constructed by the respective pixels (R, G, B). The common electrodes supply only the operating voltages required by the respective pixels. For example, a high common voltage is applied to the G pixel having low operating voltage and a low common voltage is applied to the B pixel having high operating voltage. Accordingly, a reduction in power consumption can be achieved.

Figure 4:
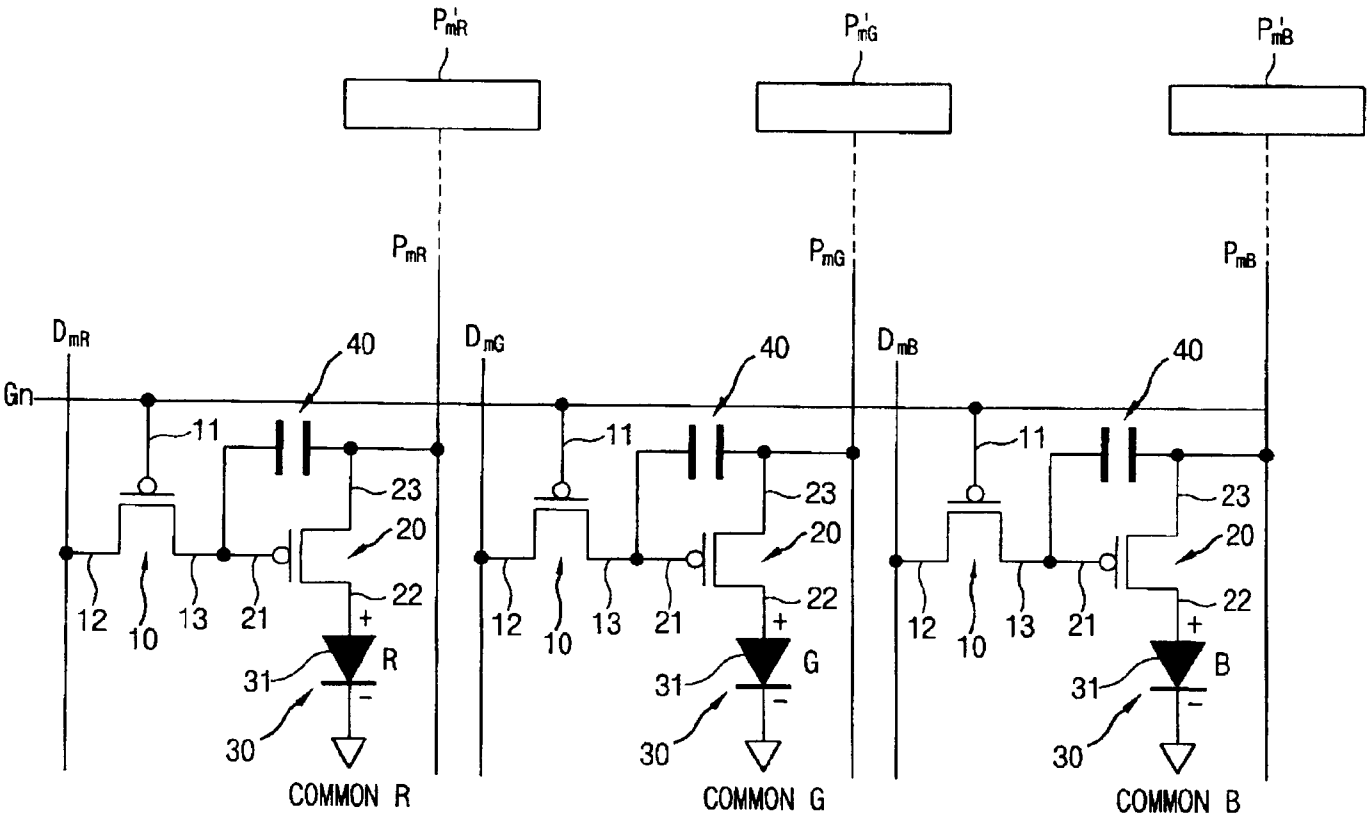

FIG. 4 shows yet another embodiment of the present invention for reducing the power consumption of the organic luminescence device.

Referring to FIG. 4, individual power voltage supplying lines for supplying the power voltage to the power voltage line and the common electrodes (common_R, common_G, common_B) are constructed on the respective pixels.

Additionally, in the present invention contrasting power voltage supplying lines or common electrodes on the respective pixels can be applied to organic EL devices of 4-TFT method. The 4-TFT method has two switching TFTs and two driving TFTs on respective pixels.

Figure 5:
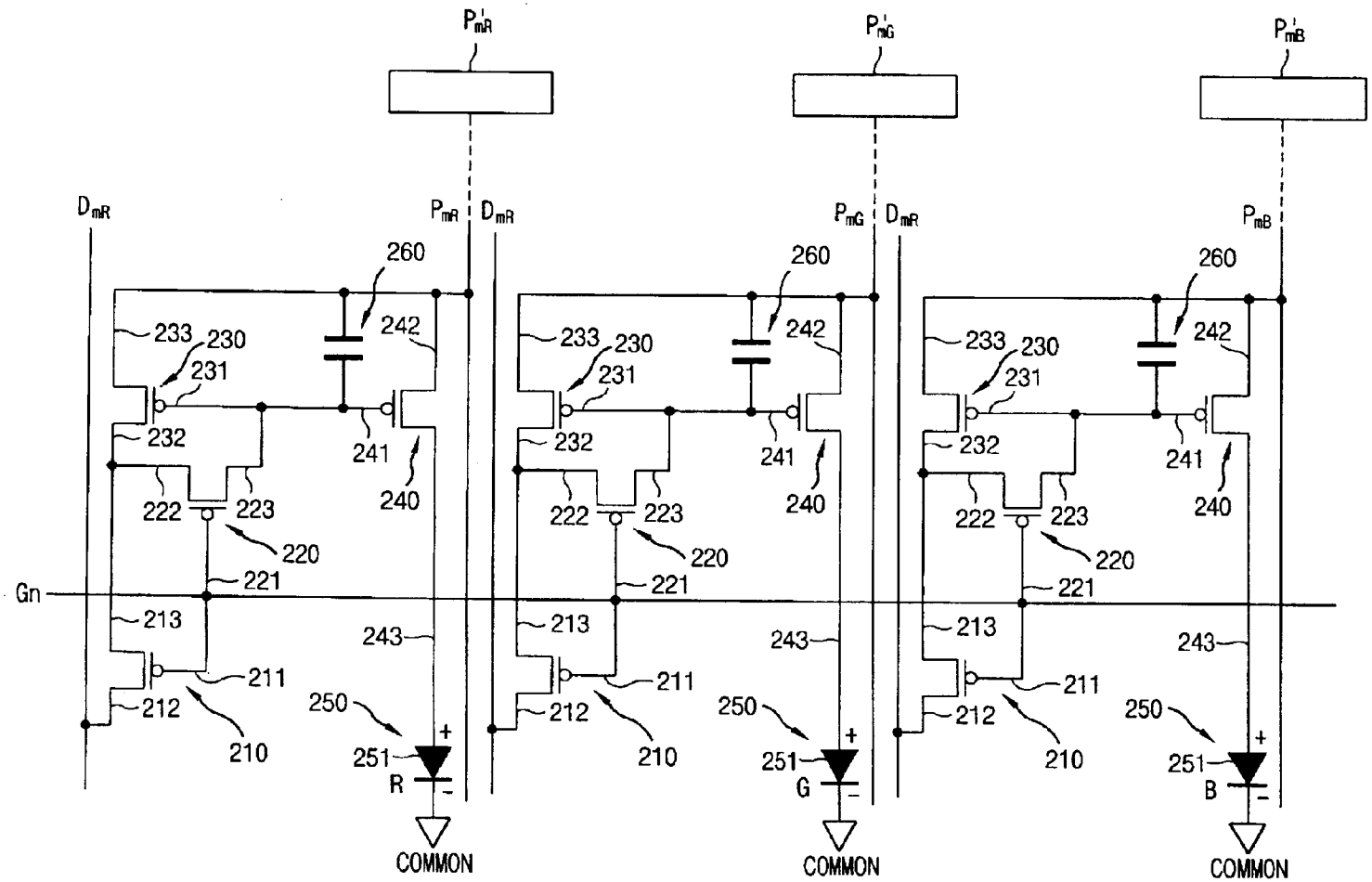
FIGS. 5 to 7 are equivalent circuit diagrams showing R, G, and B pixels of the organic luminescence device including four thin film transistors according to the present invention.
Figure 6:
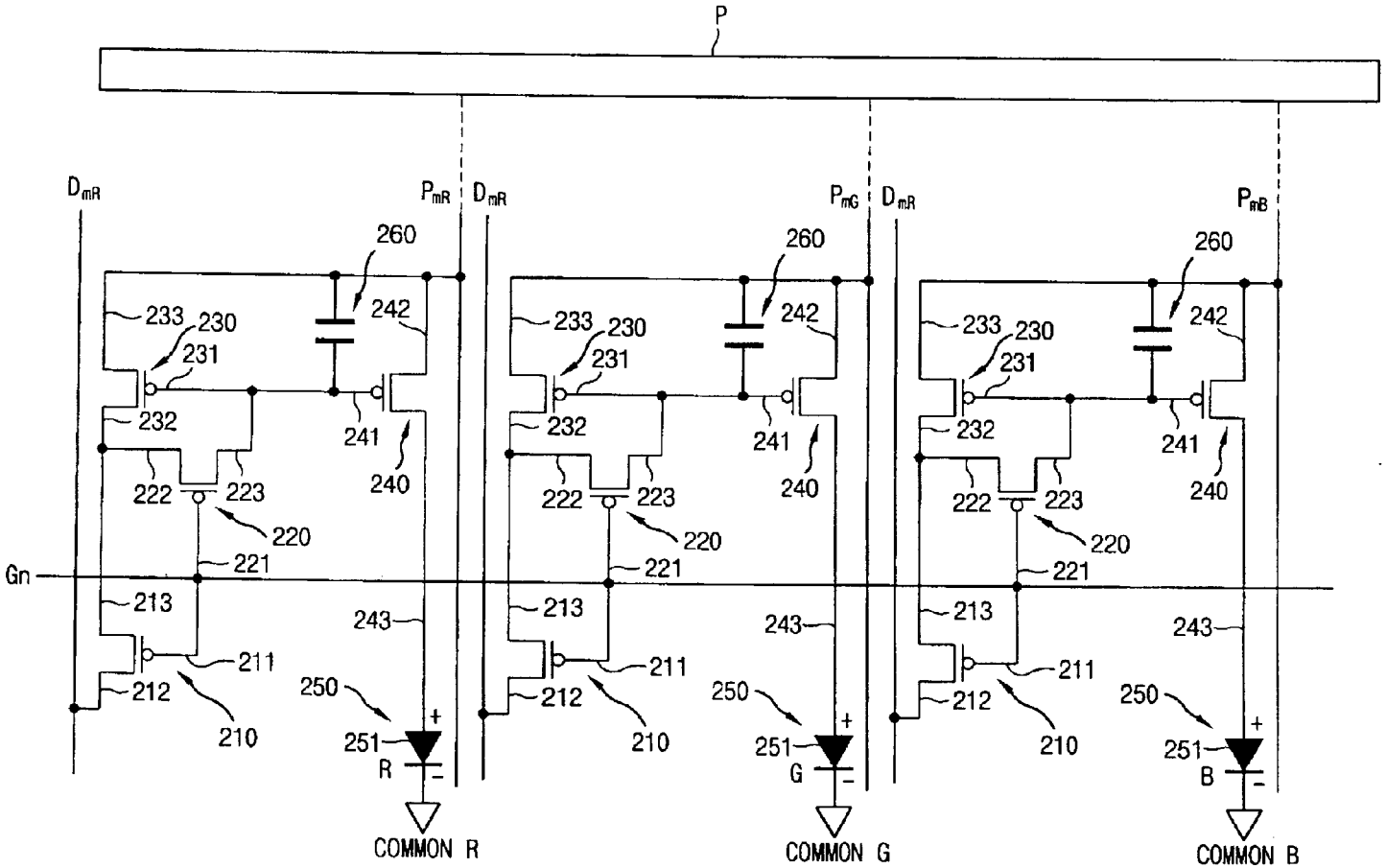
Figure 7:
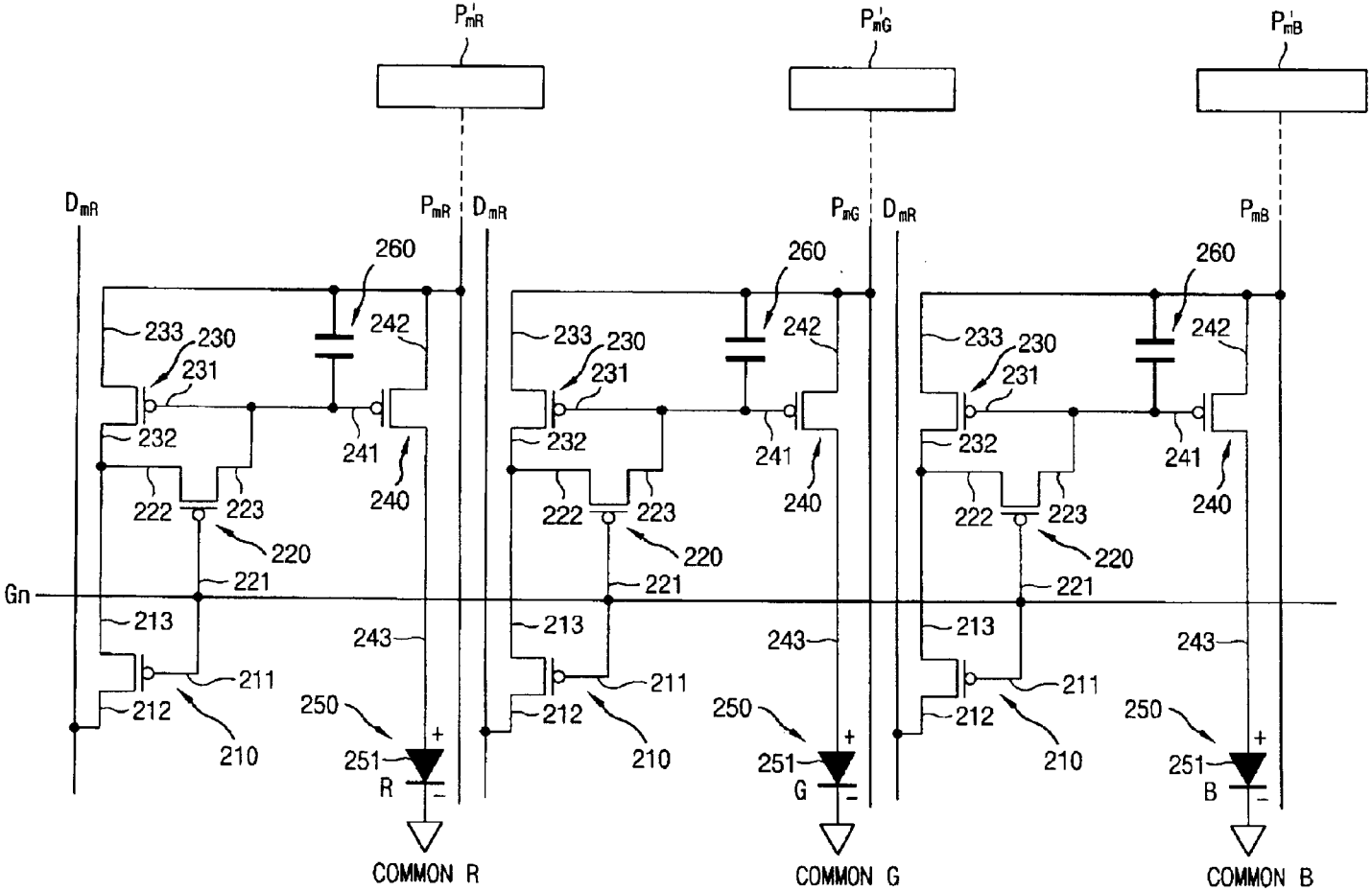

FIGS. 5 to 7 represent embodiments applied to the organic EL device of the 4-TFT method.

FIG. 5 shows the organic EL device of 4-TFT method in which the power voltage supplying line is made by pixels.

Referring to FIG. 5, an equivalent circuit comprises N lines of gate scan lines (Gn) for supplying the gate signal and data lines ($D_{mR}$, $D_{mG}$, $D_{mB}$) for supplying data signals to the respective pixels. Power voltage lines ($P_{mR}$, $P_{mG}$, $P_{mB}$) are individually formed on respective R, G, B pixels for supplying power voltages required by the pixels. First and second switching thin film transistors 210 and 220 and third and fourth driving thin film transistors 230 and 240 are formed. An organic luminescence device 250 is arranged on an area divided by the gate line, data line, and the power voltage line.

The first switching thin film transistor 210 comprises a gate electrode 211 and is connected to a gate scan line (Gn) for being supplied a gate signal. A drain electrode 212 is connected to the data line (Dm) for being supplied a data signal. A source electrode 213 is connected to a drain electrode 232 of the third driving thin film transistor 230.

Additionally, the second switching thin film transistor 220 comprises a gate electrode 221 connected to the gate scan line (Gn) for being supplied the gate signal. A drain electrode 222 is connected to a source electrode 213 of the first switching thin film transistor 210 and a drain electrode 232 of the third driving thin film transistor 230. A source electrode 223 is connected to a gate electrode 241 of the fourth driving thin film transistor 240. Also, the third driving thin film transistor 230 comprises a gate electrode 231 connected to the a source electrode 223 of the second switching thin film transistor 220. A drain electrode 232 is connected to the source electrode 213 of the first switching thin film transistor 210 and a source electrode 233 is connected to the power voltage line ($P_{mR}$, $P_{mG}$, $P_{mB}$).

The fourth driving thin film transistor 240 comprises a gate electrode 241 connected to the source electrode 223 of the second switching thin film transistor 220 and a source electrode 242 is connected to the power voltage line ($P_{mR}$, $P_{mG}$, $P_{mB}$). A drain electrode 243 connected to the positive electrode (+) of the organic luminescence device 250.

The power voltage lines ($P_{mR}$, $P_{mG}$, $P_{mB}$) connected to the source electrode 233 of the third driving thin film transistor 230 and the source electrode 233 are formed on the respective pixels individually. Accordingly, the various voltages may be supplied.

The power voltage lines are connected to power voltage supplying lines ($P'_{mR}$, $P'_{mG}$, $P'_{mB}$) formed on a printed circuit board. The power voltage supplying lines are arranged on the outer side of the panel by R, G, B pixels as in the 2-TFT method.

Additionally, the organic luminescence device 250 comprises a positive electrode (+) connected to the drain electrode 243 of the fourth driving thin film transistor 240. A negative electrode (−) is connected to a common electrode and an organic emitting layer 251 formed is inserted between the positive electrode (+) and the negative electrode (−). The organic emitting layer 251 includes a hole transport layer, an emitting layer, and an electron transport layer.

One electrode of the capacitor 260 is connected to the power voltage line ($P_{mR}$, $P_{mG}$, $P_{mB}$). The other electrode is commonly connected to the source electrode 223 of the second thin film transistor 220 and to the gate electrode 241 of the fourth driving thin film transistor 240.

The operations of the equivalent circuit of the organic EL device constructed as above will be described as follows.

A gate signal is applied from the gate scan line (Gn) and the first switching thin film transistor 210 is electrically turned on. Simultaneously, a data signal supplied from the data line (Dm) is supplied to the drain electrode 232 and to the gate electrode 231 of the third driving thin film transistor 210 through the drain electrode 212 and the source electrode 213 of the first switching thin film transistor 210. At that time, the gate signal is also applied to the gate electrode 221 of the second switching thin film transistor 220 from the gate scan line (Gn). Accordingly, the second switching transistor 220 is also electrically turned on.

The third and the fourth driving thin film transistors 230 and 240 are operated as generally well known electric current mirrors.

The amount of electric current flowing through the source electrode 233 and the drain electrode 232 of the third driving thin film transistor 230 from the power line ($P_{mR}$, $P_{mG}$, $P_{mB}$) is determined by the data signal. The data signal is supplied to the drain electrode 232 and to the gate electrode 231 of the third driving thin film transistor 230. Additionally, an electric current of the same size as above is applied to the organic luminescence device 250 through the source electrode 242 and the drain electrode 243 of the fourth driving thin film transistor 240 from the power line ($P_{mR}$, $P_{mG}$, $P_{mB}$).

The organic luminescence device 250 emits the light in proportion to the amount of the supplied electric current. The amount of the supplied electric current is decided by the data signal provided from the data line (Dm). Consequently, the strength of emitted light is determined by the data signal supplied from the data line (Dm).

The strength of light and the current characteristic are varied for the desired emitted colors of the organic luminescence device. The currents corresponding to the R, G, and B emitted colors are supplied from the power voltage supplying lines ($P'_{mR}$, $P'_{mG}$, $P'_{mB}$) formed on the printed circuit board and divided by the R, G and B pixels.

The power voltage supplying lines ($P'_{mR}$, $P'_{mG}$, $P'_{mB}$) are connected to the respective power voltage lines ($P_{mR}$, $P_{mG}$, $P_{mB}$) formed on the printed circuit board by R, G and B pixels and constructed on the respective pixel.

As described above, the operating voltages required by the respective R, G, and B pixels can be supplied by constructing the power voltage supplying line by the pixels; therefore, there are power consumption advantages.

FIG. 6 is an equivalent circuit diagram of the organic EL device of 4-TFT method in which the common electrode is constructed by pixels.

Referring to FIG. 6, the common electrodes (common_R, common_G, and common_B) are connected to negative electrodes (−) of the organic luminescence device and formed individually for the respective organic luminescence device of R, G, and B. The common electrodes supply only the operating voltages required to the respective pixels. For example, a high common voltage is applied to the G pixel having low operating voltage and a low common voltage is applied to the B pixel having high operating voltage. Accordingly, the reduction in power consumption can be achieved.

FIG. 7 is an equivalent circuit diagram showing an organic EL display device of 4-TFT method in which the power voltage supplying line and the common electrode are constructed on the respective pixels.

Referring to FIG. 7, individual power voltage supplying lines ($P'_{mR}$, $P'_{mG}$, $P'_{mB}$) for supplying the required voltage to the power voltage line and the common electrodes (common_R, common_G, common_B) are constructed on the respective pixels. Accordingly, the operating voltages required by the respective pixels can be supplied.

Although not shown in Figure, the respective power voltage supplying lines may be formed on the panel. However, it is desirable that the power voltage supplying lines are formed on a printed circuit board installed on outer side of the panel, to prevent the temperature of the panel from rising due to temperature increases of the power voltage supplying lines.

As described in the embodiments of the present invention, the power voltages are applied to the driving thin film transistors of the respective R, G, and B pixels differently for applying lower power voltages to the pixels requiring lower operating voltages. Additionally, common electrodes may be formed on the respective R, G, and B pixels for applying the high voltage to the pixel having low operating voltage; thereby the power consumption can be reduced.

Hereinafter, the amount of power consumption that can be reduced by the present invention will be described in detail with reference to following equations.

The level of power consumption can be represented as a product of the operating voltages multiplied by the operating currents. Assuming the operating voltages for R, G, and B are $V_R$, $V_G$, and $V_B$, respectively, assuming that the operating currents are $I_R$, $I_G$, and $I_B$, the entire power consumption amount of the panel according to the related art can be represented as equation 1. The related art applies the operating voltage $V_B$ for emitting the blue color having the highest operating voltage to the all R, G, and B pixels as FIG. 8.

$$\text{power consumption amount} \propto (I_R, I_G, I_B) \times V_B \qquad \text{[Equation 1]}$$

Figure 8:
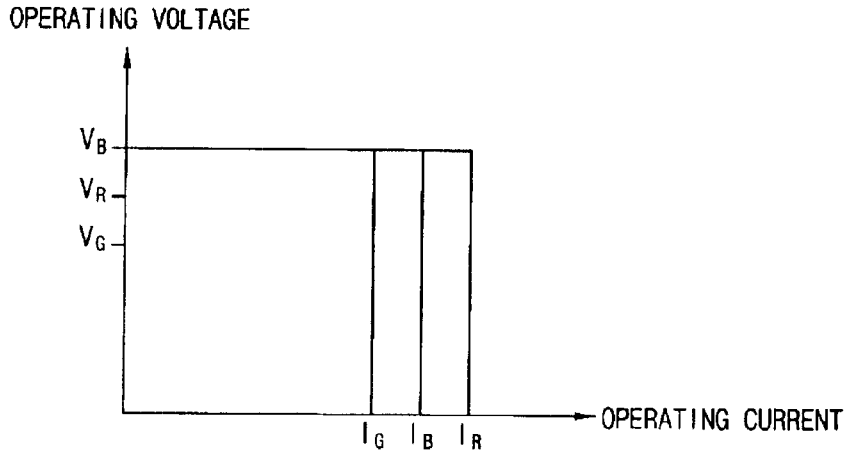
FIG. 8 is a view showing an amount of electric power used on a panel of the organic EL device according to the related art.

Referring to FIG. 8, the operating voltage $V_B$ is applied to the pixel which can be operated with the operating voltage of $V_G$. Therefore, the voltage difference of $V_B - V_G$ is generated and the power consumption amount is increased by the this amount ($V_B \times I_B - V_G \times I_G$).

Same as above, the operating voltage of $V_B$ is applied to the pixel which can be operated with the operating voltage of $V_R$. Therefore, the voltage difference of $V_B - V_R$ is generated and the power consumption amount is increased by this amount ($V_B \times I_B - V_R \times I_R$).

In the present invention, the power voltage lines are individually formed on the respective R, G, and B pixels in order to apply the operating voltage required by the respective pixels. Optionally, the common electrodes connected to the negative electrode (−) of the organic luminescence device are formed individually on the respective pixels to apply the common voltage required by the respective pixel individually.

Figure 9:
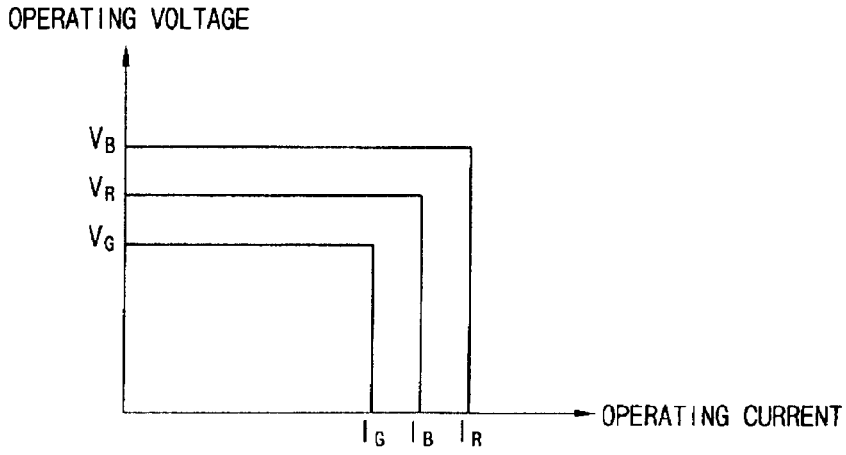
FIG. 9 is a view showing an amount of electric power used on a panel of an organic EL device according to the present invention.

The power consumption used by the panel in the organic luminescence device having the driving circuit of the present invention can be represented in following equation 2 and shown in FIG. 9.

$$\text{power consumption amount} \propto (I_B \times V_B + I_G \times V_G + I_R \times V_R) \quad \text{[Equation 2]}$$

Referring to FIG. 9, the operating voltages required by the R, G, and B pixels are in order of $V_B > V_R > V_G$, and the operating currents are in the order of $I_G > I_R > I_B$. Therefore, the power consumption can be reduced as much as $(V_B \times I_B - V_G \times I_G) + (V_B \times I_B - V_R \times I_R)$.

As described above, according to the organic EL device of the present invention, the power voltage supplying lines or the common electrodes are constructed by pixels to supply only the operating voltages required by the respective pixels. Accordingly, the power consumption amount of the organic EL device can be reduced.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic electro luminescence (EL) display device, comprising:

a gate scan line;

a data line, wherein the data line and the gate scan line cross;

red (R), green (G), and blue (B) pixels arranged in a matrix form in an area where the gate scan line and the data line cross;

an organic luminescence device corresponding to the R, G, and B pixels for emitting R, G, and B colors by an electric field applied to a positive (+) and negative (−) electrodes;

a switching unit for switching image information applied from the data line by a scan signal applied from the gate scan line;

a driving unit for applying the electric field to the organic luminescence device according to an image information applied through the switching unit;

a power voltage supplying line formed individually on the R, G and B pixels for applying different power voltages to the driving units formed on the respective pixels; and a common electrode for supplying a common voltage to the organic luminescence device.

2. The device of claim 1, wherein the common voltage is supplied to the negative electrode (−) of the organic luminescence device.

3. The device of claim 1, wherein the common electrode is respectively formed on the respective R, G and B pixels, individually, for applying common voltage to the respective pixels.

4. The device of claim 1, wherein the switching unit comprises at least one thin film transistors.

5. The device of claim 1, wherein the driving unit comprises at least one thin film transistors.

6. The device of claim 1, wherein the power voltage supplying line is formed on a panel.

7. The device of claim 1, wherein the power voltage supplying line is formed on a printed circuit board.

8. An organic EL display device, comprising:

a gate scan line;

a data line, wherein the data line crosses the gate scan line;

red (R), green (G), and blue (B) pixels arranged in a matrix form in an area where the gate scan line and the data line cross;

an organic luminescence device corresponding to the R, G, and B pixels for emitting R, G, and B colors by an electric field applied to a positive (+) and negative (−) electrodes;

a switching unit for switching image information applied from the data line by a scan signal applied from the gate scan line;

a driving unit for applying the electric field to the organic luminescence device according to an image information applied through the switching unit;

a power voltage supplying line formed individually on the R, G and B pixels for applying different power voltages to the driving units formed on the respective pixels; and a common electrode formed on respective R, G and B pixels for supplying common voltages different from each other to the respective pixels.

9. The device of claim 8, wherein the switching unit includes at least one thin film transistors.

10. The device of claim 8, wherein the driving unit includes at least one thin film transistors.

11. The device of claim 8, wherein the power voltage supplying line is formed on a panel.

12. The device of claim 8, wherein the power voltage supplying line is formed on a printed circuit board.

13. An organic EL display device comprising:

a gate scan line;

a data line, wherein the data line cross the gate scan line;

red (R), green (G), and blue (B) pixels arranged in a matrix form in an area where the gate scan line and the data line cross;

an organic luminescence device corresponding to the R, G, and B pixels for emitting R, G, and B colors by an electric field applied to a positive (+) and negative (−) electrodes;

a switching unit for switching image information applied from the data line by a scan signal applied from the gate scan line;

a driving unit for applying the electric field to the organic luminescence device according to an image information applied through the switching unit;

a power voltage supplying line for applying power voltages to the driving units formed on the respective pixels; and a common electrode formed on the respective R, G and B pixels individually for supplying common voltages different from each other to the respective pixels.

14. The device of claim 13, wherein the power voltage supplying lines are formed on the R, G, and B pixels, individually, for applying power voltages different from each other to the driving units formed on the respective pixels.

15. The device of claim 13, wherein the switching unit includes at least one thin film transistor.

16. The device of claim 13, wherein the driving unit includes at least one thin film transistor.

17. The device of claim 13, wherein the power voltage supplying line is formed on a panel.

18. The device of claim 13, wherein the power voltage supplying line is formed on a printed circuit board.

* * * * *